US009302195B2

(12) United States Patent
Paul

(10) Patent No.: US 9,302,195 B2
(45) Date of Patent: Apr. 5, 2016

(54) SPINNING TOY ASSEMBLY

(71) Applicant: Urban S. Paul, Bakersfield, CA (US)

(72) Inventor: Urban S. Paul, Bakersfield, CA (US)

( * ) Notice: Subject to any disclaimer, the term of this patent is extended or adjusted under 35 U.S.C. 154(b) by 0 days.

(21) Appl. No.: 14/308,817

(22) Filed: Jun. 19, 2014

(65) Prior Publication Data

US 2015/0367244 A1 Dec. 24, 2015

(51) Int. Cl.

| | |
|---|---|
| ***A63H 27/00*** | (2006.01) |
| ***A63H 33/00*** | (2006.01) |
| ***A63H 33/26*** | (2006.01) |
| ***A63H 29/22*** | (2006.01) |

(52) U.S. Cl.

CPC ..... *A63H 33/002* (2013.01); *A63H 29/22* (2013.01); *A63H 33/26* (2013.01)

(58) Field of Classification Search

USPC ..... 446/46, 47, 48, 214, 215, 242, 243, 446/247, 253, 254

See application file for complete search history.

(56) References Cited

U.S. PATENT DOCUMENTS

| | | | | | |
|---|---|---|---|---|---|
| 2,117,133 | A | | 5/1938 | Bell | |
| 3,004,365 | A | | 10/1961 | Bertucci | |
| 3,010,248 | A | * | 11/1961 | Ellman et al. | 446/22 |
| D200,421 | S | | 2/1965 | Ruf | |
| 3,501,860 | A | | 3/1970 | Bandy | |
| 4,112,612 | A | * | 9/1978 | Woods | 446/48 |
| 4,189,862 | A | | 2/1980 | Lopez | |
| 4,552,542 | A | * | 11/1985 | Reysman | 446/254 |
| 4,990,091 | A | * | 2/1991 | Mir-Heidari | 434/98 |
| 6,120,342 | A | | 9/2000 | Chan | |
| 6,390,879 | B1 | * | 5/2002 | Spector | 446/46 |
| 6,404,409 | B1 | * | 6/2002 | Solomon | 345/31 |
| 6,482,137 | B2 | * | 11/2002 | Walker | 482/110 |
| 6,682,384 | B2 | * | 1/2004 | Wang | 446/46 |
| 6,776,680 | B2 | * | 8/2004 | Chow | 446/247 |
| 6,802,758 | B2 | * | 10/2004 | Somers | 446/242 |
| 7,037,169 | B2 | * | 5/2006 | Benedek et al. | 446/242 |
| 7,361,074 | B1 | * | 4/2008 | Periman et al. | 446/242 |
| 7,740,518 | B2 | * | 6/2010 | Elliott | 446/256 |
| 7,766,718 | B2 | * | 8/2010 | Rago et al. | 446/242 |
| 7,997,951 | B2 | * | 8/2011 | Rooney | 446/214 |
| 8,668,631 | B1 | * | 3/2014 | Riley | 482/126 |
| 8,911,274 | B1 | * | 12/2014 | Campana | 446/46 |
| 2004/0141321 | A1 | * | 7/2004 | Dowling et al. | 362/276 |

FOREIGN PATENT DOCUMENTS

| | | |
|---|---|---|
| BE | 1003925 A | 7/1992 |
| GB | 2425270 A9 | 4/2009 |

* cited by examiner

*Primary Examiner* — Kurt Fernstrom

(57) ABSTRACT

A spinning toy assembly includes a pair of cords each coupled between a pair of rings. The pair of rings is gripped by a user. A plate is positioned on each of the pair of cords. The plate is spun by the user so the pair of cords are twisted around each other. The pair of cords transfers a twisting inertia into the plate so the plate is rapidly spun. A processor is coupled to the plate. A light emitter is coupled to the plate and the processor. A speaker is coupled to the plate and the processor. The speaker and the light emitter is each actuated the plate is spun. A sensor is coupled to the plate and the processor. The sensor detects a rotation of the plate. The sensor actuates the processor when the plate is spun on the pair of strings.

11 Claims, 4 Drawing Sheets

SPINNING TOY ASSEMBLY

BACKGROUND OF THE DISCLOSURE

Field of the Disclosure

The disclosure relates to toy devices and more particularly pertains to a new toy device for being held by a user and spun using inertia.

SUMMARY OF THE DISCLOSURE

An embodiment of the disclosure meets the needs presented above by generally comprising a pair of cords each coupled between a pair of rings. The pair of rings is gripped by a user so the pair of cords extends between each of the user's hands. A plate is positioned on each of the pair of cords. The pair of cords passes laterally through the plate. The plate is spun by the user such that the pair of cords are twisted around each other. The user grips each of the pair of rings and pulls outwardly. The pair of cords transfers a twisting inertia into the plate so the plate is rapidly spun. A processor is coupled to the plate. A light emitter is coupled to the plate. The light emitter is operationally coupled to the processor. The light emitter selectively emits light when the plate is spun. A speaker is coupled to the plate. The speaker is operationally coupled to the processor. The speaker selectively emits an audible sound when the plate is spun. A sensor is coupled to the plate. The sensor is operationally coupled to the processor. The sensor detects a rotation of the plate. The sensor actuates the processor when the plate is spun on the pair of strings.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
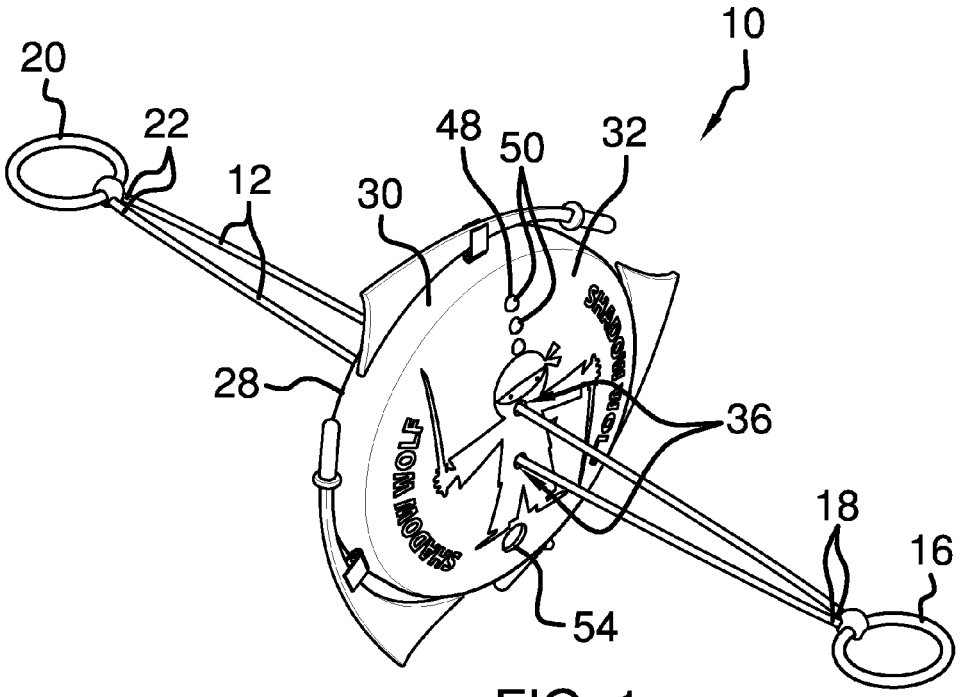
FIG. 1 is a right side perspective view of a spinning toy assembly according to an embodiment of the disclosure.
Figure 2:
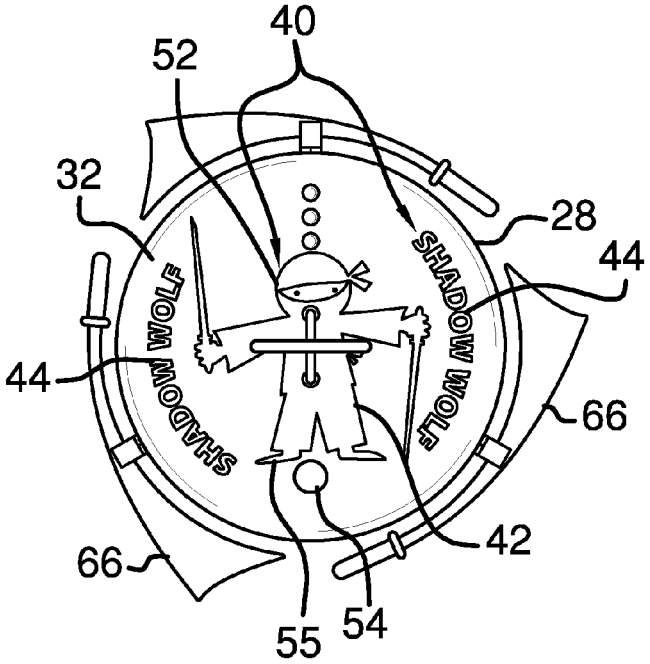
FIG. 2 is a right side view of an embodiment of the disclosure.
Figure 3:
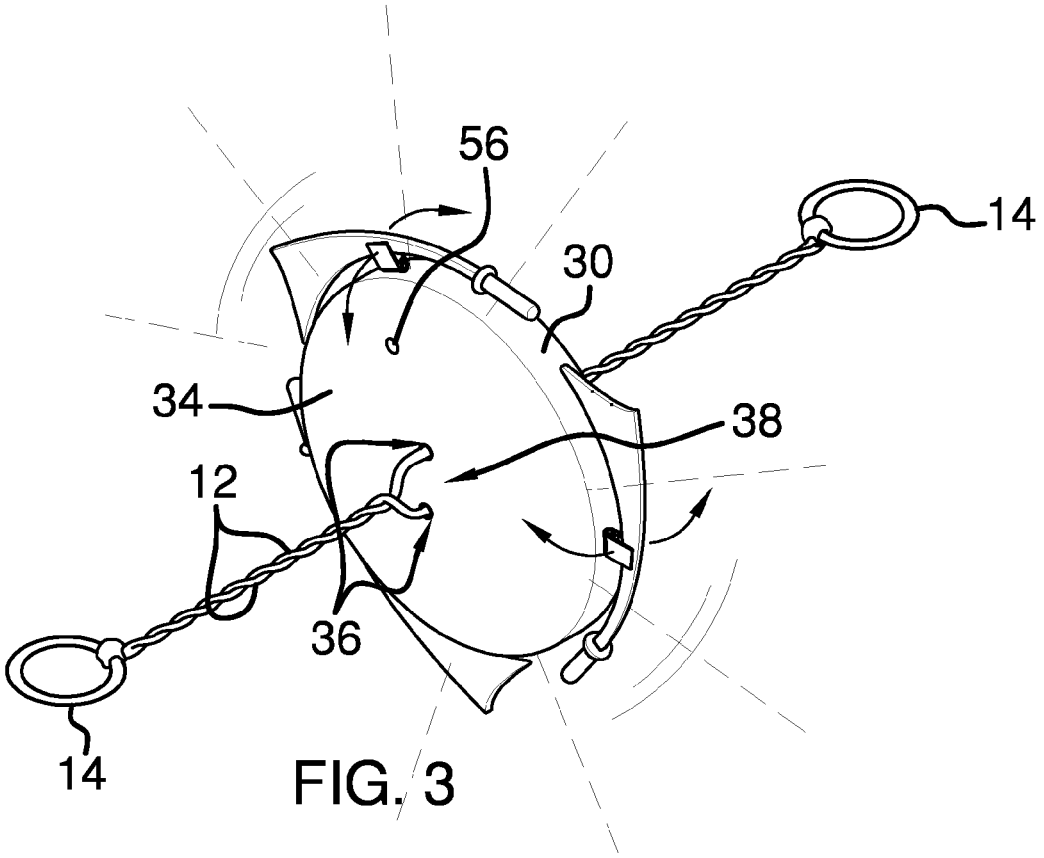
FIG. 3 is a left side perspective view of an embodiment of the disclosure.
Figure 4:
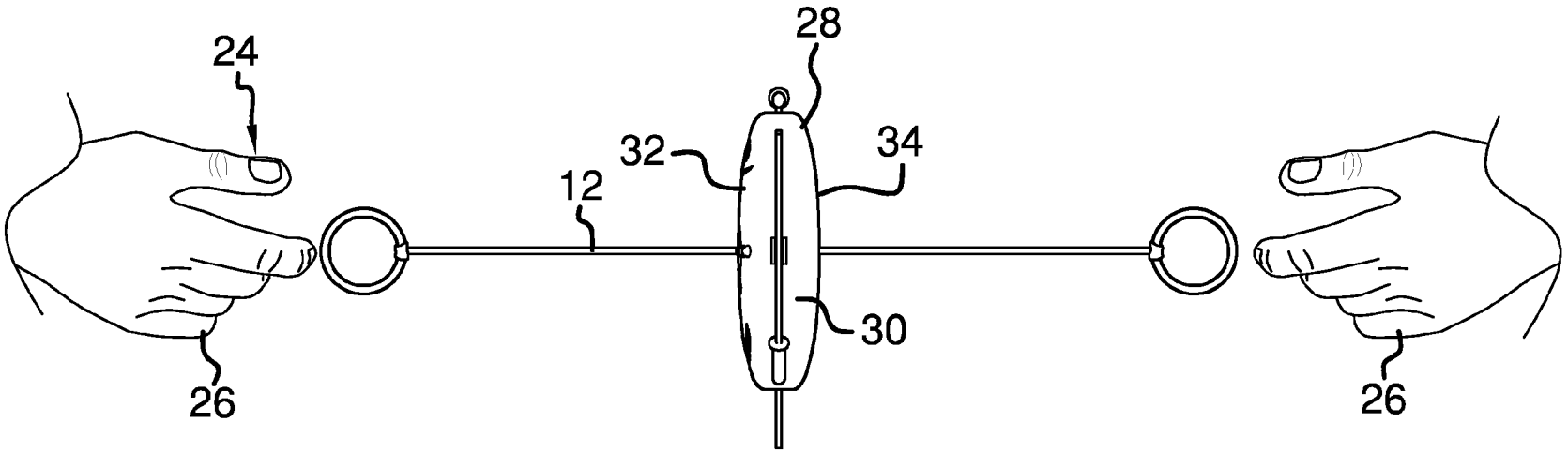
FIG. 4 is a back side view of an embodiment of the disclosure.
Figure 5:
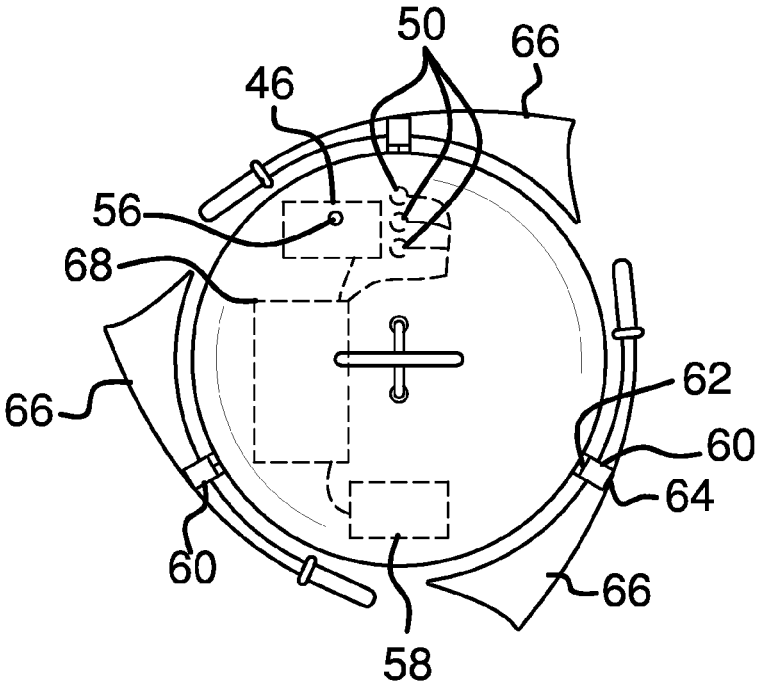
FIG. 5 is a left side view of an embodiment of the disclosure.
Figure 6:
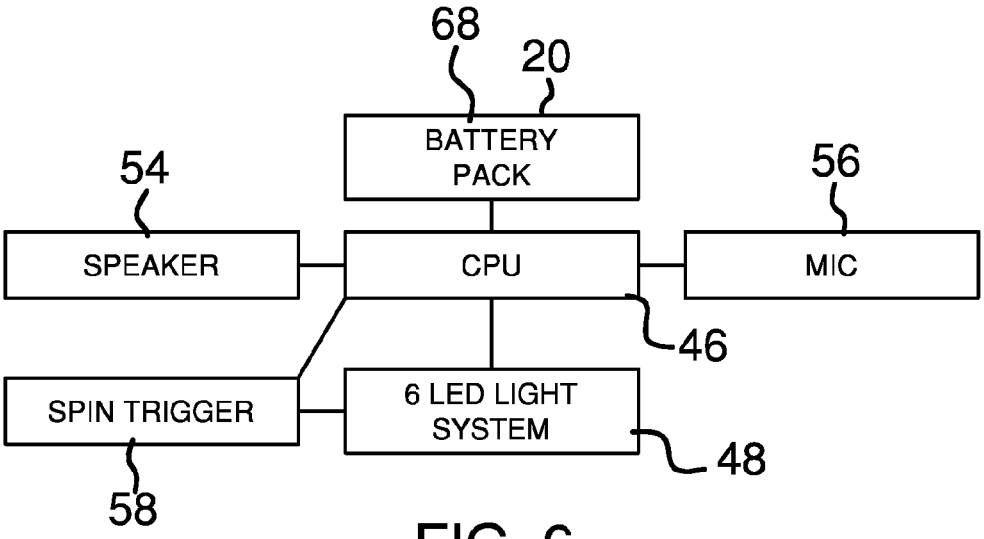
FIG. 6 is a schematic view of an embodiment of the disclosure.

With reference now to the drawings, and in particular to FIGS. 1 through 6 thereof, a new toy device embodying the principles and concepts of an embodiment of the disclosure and generally designated by the reference numeral 10 will be described.

As best illustrated in FIGS. 1 through 6, the spinning toy assembly 10 generally comprises a pair of cords 12 coupled between a pair of rings 14. The pair of rings 14 comprise a first one 16 of the pair of rings 14 coupled to a first end 18 of each of the pair of cords 12. The pair of rings 14 further comprise a second one 20 of the pair of rings 14 coupled to a second end 22 of each of the pair of cords 12. The first 16 and second 20 rings are each gripped by a user 24 so the pair of cords 12 extends between each of the user's hands 26.

A plate 28 is provided. The plate 28 has an outer edge 30 extending between a first lateral side 32 and a second lateral side 34 of the plate 28. Additionally, the plate 28 has a pair of cord apertures 36 extending through each of the first 32 and second 34 lateral sides of the plate 28. The pair of cord apertures 36 each is evenly spaced apart from a center 38 of the plate 28. The outer edge 30 of the plate 28 is curvilinear so the plate 28 has a disk shape.

The first lateral side 32 of the plate 28 has indicia 40 printed thereon. The indicia 40 may comprise a cartoon character 42. The cartoon character 42 may be an image of a ninja. Moreover, the cartoon character 42 is centrally positioned on the first lateral side 32 of the plate 28.

The indicia 40 may additionally comprise a pair of words 44. The pair of words 44 may each comprise "Shadow Wolf". Each of the pair of the words 44 are positioned proximate opposite sides of the first lateral side 32 of the plate 28. The pair of words 44 are each coextensive with the outer edge 30 of the plate 28.

Each of the pair of cords 12 extends through an associated one of the pair of cord apertures 36. The plate 28 is spun in a first direction by the user 24 so the pair of cords 12 are twisted around each other. The user 24 grips each of the first 16 and second 20 rings and pulls outwardly on each of the first 16 and second 20 rings. Continuing, the pair of cords 12 transfers a twisting inertia into the plate 28. The plate 28 is rapidly spun in a second direction.

A processor 46 is coupled to the plate 28. The processor 46 may be an electronic processor of any conventional design. A light emitter 48 is coupled to the first lateral side 32 of the plate 28. The light emitter 48 is electrically coupled to the processor 46. The light emitter 48 selectively emits light when the plate 28 is spun.

The light emitter 48 is one of a plurality of light emitters 50. Each of the plurality of light emitters 50 is evenly spaced apart and distributed between the cartoon character's head 52 and the outer edge 30 of the plate 28. Additionally, each of the plurality of light emitters 50 may be an LED of any conventional design.

A speaker 54 is coupled to the first lateral side 32 of the plate 28. The speaker 54 is positioned between the cartoon character's feet 55 and the outer edge 30 of the plate 28. Additionally, the speaker 54 is electrically coupled to the processor 46. The speaker 54 selectively emits an audible sound when the plate 28 is spun.

A microphone 56 is coupled to the second lateral side 34 of the plate 28. The microphone 56 is electrically coupled to the processor 46. The microphone 56 records the user's voice. Additionally, the user's voice is stored in the processor 46. The speaker 54 selectively emits the user's voice when the plate 28 is spun.

A sensor 58 is coupled to the plate 28. The sensor 58 is electrically coupled to the processor 46. Additionally, the sensor 58 detects a rotation of the plate 28. The processor 46 actuates the plurality of light emitters 50 and the speaker 54 when the sensor 58 detects the rotation of the plate 28. The sensor 58 may be a motion sensor of any conventional design.

A plurality of clips 60 is provided. Each of the plurality of clips 60 has a coupled end 62 and a free end 64. The coupled end 62 of each of the plurality of clips 60 is hingedly coupled to the outer edge 30 of the plate 28. Moreover, the plurality of clips 60 is evenly spaced apart and distributed around an entire circumference of the plate 28.

A plurality of decorations 66 is each engaged by the free end 64 of an associated one of the plurality of clips 60. The plurality of decorations 66 is each retained on the plate 28. Each of the plurality of decorations 66 may comprise a sword. The plurality of decorations 66 each alternatively tips toward each of the first 32 and second 34 lateral sides of the plate 28 when the plate 28 is spun.

A power supply 68 is coupled to the plate 28. The power supply 68 is electrically coupled to the processor 46. The power supply 68 comprises at least one battery 70. Finally, the power supply 68 may have an operational voltage between 1.5 VDC and 3 VDC.

In use, the plate 28 is spun in the first direction to twist the pair of cords 12. The user 24 grips the first 16 and second 20 rings and pulls the first 16 and second 20 rings away from each other. The plate 28 rotates rapidly in the second direction. As the plate 28 rotates in the second direction, the user 24 moves the first 16 and second 20 rings toward each other so the inertia of the plate 28 allows the pair of cords 12 to become twisted in the first direction. The user 24 pulls the first 16 and second 20 rings away from each other after the plate 28 has ceased rotation in the second direction. The plate 28 begins to rotate in the first direction. The user 24 continually pulls and releases the first 16 and second 20 rings to keep the plate 28 alternately rotating in the first and second directions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A spinning toy assembly configured to be held by a user and spun using inertia, said assembly comprising:

a pair of cords each coupled between a pair of rings such that said pair of rings is configured for being gripped by the user such that said pair of cords extends between each of the user's hands;

a plate positioned on each of said pair of cords such that said pair of cords passes laterally through said plate wherein said plate is configured for being spun by the user pulling outwardly when said cords are twisted such that said pair of cords transfers a twisting inertia into said plate such that said plate is rapidly spun;

a processor coupled to said plate;

a light emitter coupled to said plate, said light emitter being operationally coupled to said processor such that said light emitter selectively emits light when said plate is spun;

a speaker coupled to said plate, said speaker being operationally coupled to said processor such that said speaker selectively emits an audible sound when said plate is spun;

a microphone coupled to said plate, said microphone being electrically coupled to said processor such that said microphone is configured to record a voice of the user wherein the voice of the user is emitted when said plate is spun; and a sensor coupled to said plate, said sensor being operationally coupled to said processor, said sensor detecting a rotation of said plate such that said sensor actuates said processor when said plate is spun on said pair of strings.

2. The assembly according to claim 1, wherein said pair of rings comprising a first one of said pair of rings coupled to a first end of each of said pair of cords and a second one of said pair of rings coupled to a second end of each of said pair of cords.

3. The assembly according to claim 1, wherein said plate having an outer edge extending between a first lateral side and a second lateral side of said plate, said plate having a pair of cord apertures extending through each of said first and second lateral sides of said plate, said pair of cord apertures each being evenly spaced apart from a center of said plate.

4. The assembly according to claim 3, wherein each of said pair of cords extends through an associated one of said pair of cord apertures.

5. The assembly according to claim 1, wherein said light emitter is electrically coupled to said processor.

6. The assembly according to claim 1, wherein said speaker is electrically coupled to said processor.

7. The assembly according to claim 1, wherein sensor is electrically coupled to said processor.

8. The assembly according to claim 1, wherein a plurality of clips each having a coupled end and a free end, said coupled end of each of said plurality of clips being coupled to an outer edge of said plate, said plurality of clips being evenly spaced apart and distributed around an entire circumference of said plate.

9. The assembly according to claim 8, further comprising a plurality of decorations, each of said decorations each being engaged by said free end of an associated one of said plurality of clips such that said plurality of decorations is retained on said plate.

10. The assembly according to claim 1, wherein:

a power supply coupled to said plate;

said power supply being electrically coupled to said processor; and said power supply comprising at least one battery.

11. A spinning toy assembly configured to be held by a user and spun using inertia, said assembly comprising:

a pair of cords each coupled between a pair of rings;

said pair of rings comprising a first one of said pair of rings coupled to a first end of each of said pair of cords and a second one of said pair of rings coupled to a second end of each of said pair of cords wherein said pair of rings is configured for each of said first and second rings being gripped by the user such that said pair of cords extends between each of the user's hands;

a plate having an outer edge extending between a first lateral side and a second lateral side of said plate, said plate having a pair of cord apertures extending through each of said first and second lateral sides of said plate, said pair of cord apertures each being evenly spaced apart from a center of said plate;

each of said pair of cords extending through an associated one of said pair of cord apertures such that said plate is configured for being spun by the user pulling outwardly on said rings when said cord is twisted such that said pair of cords untwist and transfer a twisting inertia into said plate such that said plate is rapidly spun;

a processor coupled to said plate;

a light emitter coupled to said plate, said light emitter being electrically coupled to said processor such that said light emitter selectively emits light when said plate is spun;

a speaker coupled to said plate, said speaker being electrically coupled to said processor such that said speaker selectively emits an audible sound when said plate is spun;

a sensor coupled to said plate, said sensor being electrically coupled to said processor, said sensor detecting a rotation of said plate such that said sensor actuates said processor when said plate is spun on said pair of strings;

a microphone coupled to said plate, said microphone being electrically coupled to said processor such that said microphone is configured to record a voice of the user wherein the voice of the user is emitted when said plate is spun;

a plurality of clips each having a coupled end and a free end, said coupled end of each of said plurality of clips being coupled to said outer edge of said plate, said plurality of clips being evenly spaced apart and distributed around an entire circumference of said plate;

a plurality of decorations each being engaged by said free end of an associated one of said plurality of clips such that said plurality of decorations is retained on said plate; and a power supply coupled to said plate, said power supply being electrically coupled to said processor, said power supply comprising at least one battery.

* * * * *